United States Patent [19]

Nykopp

[11] 4,124,441

[45] Nov. 7, 1978

[54] SHEET FORMING APPARATUS INCLUDING EDGE SEALS FOR FORMING WIRES

[75] Inventor: Erik A. Nykopp, Tampere, Finland

[73] Assignee: Oy Tampella AB, Tampere, Finland

[21] Appl. No.: 765,694

[22] Filed: Feb. 4, 1977

[30] Foreign Application Priority Data

Feb. 6, 1976 [FI] Finland ..... 760291

[51] Int. Cl.[2] ..... D21F 1/00

[52] U.S. Cl. ..... 162/301; 162/317; 162/346; 162/353

[58] Field of Search ..... 162/273, 301, 312, 317, 162/203, 346, 353, 334

[56] References Cited

U.S. PATENT DOCUMENTS

| | | | |
|---|---|---|---|
| 2,737,088 | 3/1956 | Heys | 162/334 X |
| 3,224,928 | 12/1965 | Lee et al. | 162/203 X |
| 3,619,362 | 11/1971 | Parker | 162/301 |
| 3,645,842 | 2/1972 | Ward | 162/317 X |

FOREIGN PATENT DOCUMENTS

| | | |
|---|---|---|
| 50,648 | 2/1976 | Finland. |
| 931,976 | 7/1963 | United Kingdom. |
| 1,015,841 | 1/1966 | United Kingdom. |
| 1,261,117 | 1/1972 | United Kingdom. |

*Primary Examiner*—Richard V. Fisher

*Attorney, Agent, or Firm*—Roylance, Abrams, Berdo & Farley

[57] ABSTRACT

An apparatus for forming a fibrous sheet, which apparatus comprises a first and a second endless wire for accomplishing a forming zone between mutually converging wires; a feed box with lips forming an outlet opening for feeding fibre suspension into the gap of the forming zone between the wires, the first wire being in an essentially tight contact with the first lip of the feed box, the second wire being in an essentially tight contact with the other lip of the feed box, and on both sides of the forming zone mutually essentially parallel side walls being arranged for tightening both sides of the forming zone against the wires; and rolls for guiding the wires, whereby the second wire is, at least along the sheet forming zone, arranged to run along the surface of a wire cylinder equipped with suction devices, whereby the first wire, which is guided from a breast roll arranged on the opposite side of the feed box relative to the wire cylinder, is, at least along the sheet forming zone, arranged to run carried by the sheet to be formed along the surface of the wire cylinder.

3 Claims, 4 Drawing Figures

(A-A)

(B-B)

SHEET FORMING APPARATUS INCLUDING EDGE SEALS FOR FORMING WIRES

BACKGROUND OF THE INVENTION

This invention relates to an apparatus for forming a fibrous sheet, especially a paper sheet, which apparatus comprises a first and a second endless wire for accomplishing a forming zone between mutually converging wires, a feed box with lips forming an outlet opening for feeding fibre suspension into the forming zone between the wires, and rolls for guiding the wires, wherein the second wire is, for at least the length of the sheet forming zone, arranged to run along the surface of a wire cylinder, possibly equipped with suction devices, wherein the first wire, which is guided from the breast roll arranged on the opposite side of the feed box relative to the wire cylinder, is at least along the length of the sheet forming zone, arranged to run carried by the sheet to be formed along the surface of the wire cylinder.

The prior art discloses a paper machine having a first endless wire with an initial section of Fourdrinier type for dewatering the web in this initial section to such a couching rate that the fibers shift no more relative to each other. After this initial section the web is passed on said first wire between said first wire and another wire on top thereof to withdraw further water from the web. In this subsequent section the path of the web is curved downwards in order to withdraw further water from the web through the upper second wire by means of centrifugal force and pressure applied from beneath the first wire. Accordingly, water is withdrawn from the web in two directions, through the first wire in said initial section and through the upper second wire in the subsequent section.

On the basis of research and test runs of long duration it has been found out, however, that in order to limit the escape of additives from the pulp sheet, and to increase the bond, the sheet forming does not necessarily demand a careful primary drainage on a long primary part with one wire. The disadvantages with this known solution are its expense, the large amount of room requied, the long time taken by the gentie primary drainage, and the difficulty of control and regulation.

A paper machine wire section is also known, which comprises a wire arranged on a cylinder, and a feed box which feeds pulp between the cylinder and the wire and which is equipped with an adjustable lip for controlling the size of the outlet opening.

In the cylinder there can be a suction zone facing towards the whole lip and extending beyond it in order to remove water from the pulp suspension in the pressurized primary forming zone situated under the lip. Because of the pressure, dewatering is very effective in this primary forming section.

In these devices the dewatering is easy to control by means of the adjustable lip, but it has been noticed that under the lip wrinkles and whirling are easily created, apparently due to centrifugal force and the friction between the upper lip and the pulp suspension.

Paper machines are also known in which the whole forming zone is between two wires placed along a part of a cyliner surface, or between the cylinder and a wire placed round a part of the cylinder surface. In these paper machines no harmful whirling is created, because water is removed only along the section between the wires or between the wire and the cylinder, which has the same speed as the pulp. In these devices the pressure in the forming zone, however, is not high enough, and the drainage speed of the pulp sheet is thus not high enough for the machine to be driven with a low speed and/or a strongly diluted pulp suspension. A high pressure in the forming zone would only cause the pulp to flow back from the gap, and create sideflows on the sides of the forming zone, especially when the speed is below around 300 m/min.

The object of this invention is to eliminate the above disadvantages and to create an apparatus for forming a fibre sheet, in which device the dewatering is effective and controlled, without any harmful whirling being formed in the forming zone, and higher pressures can be allowed than before in the forming zone.

SUMMARY OF THE INVENTION

According to the invention, the first wire is in an essentially tight contact with the first lip of the feed box, the second wire is in an essentially tight contact with the second lip of the feed box, and on both sides of the forming zone mutually essentially parallel side walls are provided for tightening both sides of the forming zone against the wires.

In a paper machine according to the invention the forming zone is thus between two wires, so that no rubbing motion takes place between the pulp suspension and a fixed surface, because the wires move essentially with the same speed as the pulp suspension. Further it has been stated that the dewatering can take place even in a 20 cm long space under pressure. In order to maintain the high pressure remaining in the forming zone, immediately on the inner side of the first wire there has been arranged a roll or forming shoe, which is regulatable essentially at right angles to the said wires in order to force this wire towards the wire cylinder for creating a tight joint between the first wire and the lip of the feed box.

According to the invention both sides of the forming zone have been tightened towards the wires by means of mutually essentially parallel side walls placed on both sides of the forming zone. With these walls, a higher than normal pressure can be maintained in the forming zone without causing the pulp to flow back from the gap, or sideflows to be created on the sides. Due to the higher pressure remaining in the sheet forming zone the dewatering is made essentially more effective.

DESCRIPTION OF THE PREFERRED EMBODIMENTS

Figure 1:
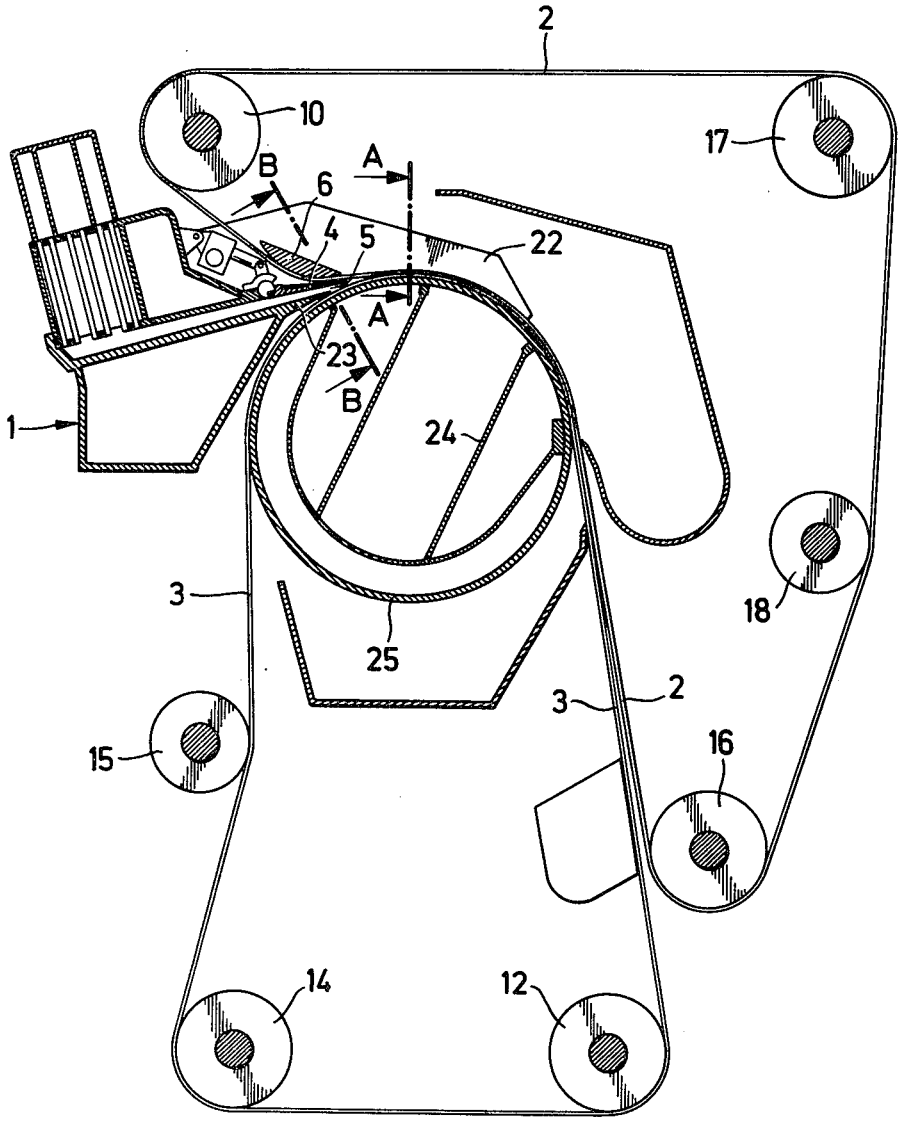
FIG. 1 shows a side view of an advantageous embodiment of the invention adapted to a paper machine secondary unit.

In FIG. 1 the feed box is marked with reference number 1. The distance between the lips 4, 23 of the feed box 1 can be regulated in order to get a desired lip opening. The lip opening of the feed box 1 penetrates into a gap 5 of a converging forming zone formed by two endless wires 2 and 3. The outer wire i.e. the first wire 2 is arranged so that it runs from a breast roll 10, over a part of the surface of a wire cylinder 25 which is equipped with a suction zone 24, and, guided by rolls 16–18, back to the wire cylinder 25. The inner wire i.e. the second wire 3 again is arranged so that it runs over the same part of the surface of the wire cylinder 25 as the first wire 2, and returns, guided by the rolls 12, 14 and 15, back to the wire cylinder 25.

Figure 4:
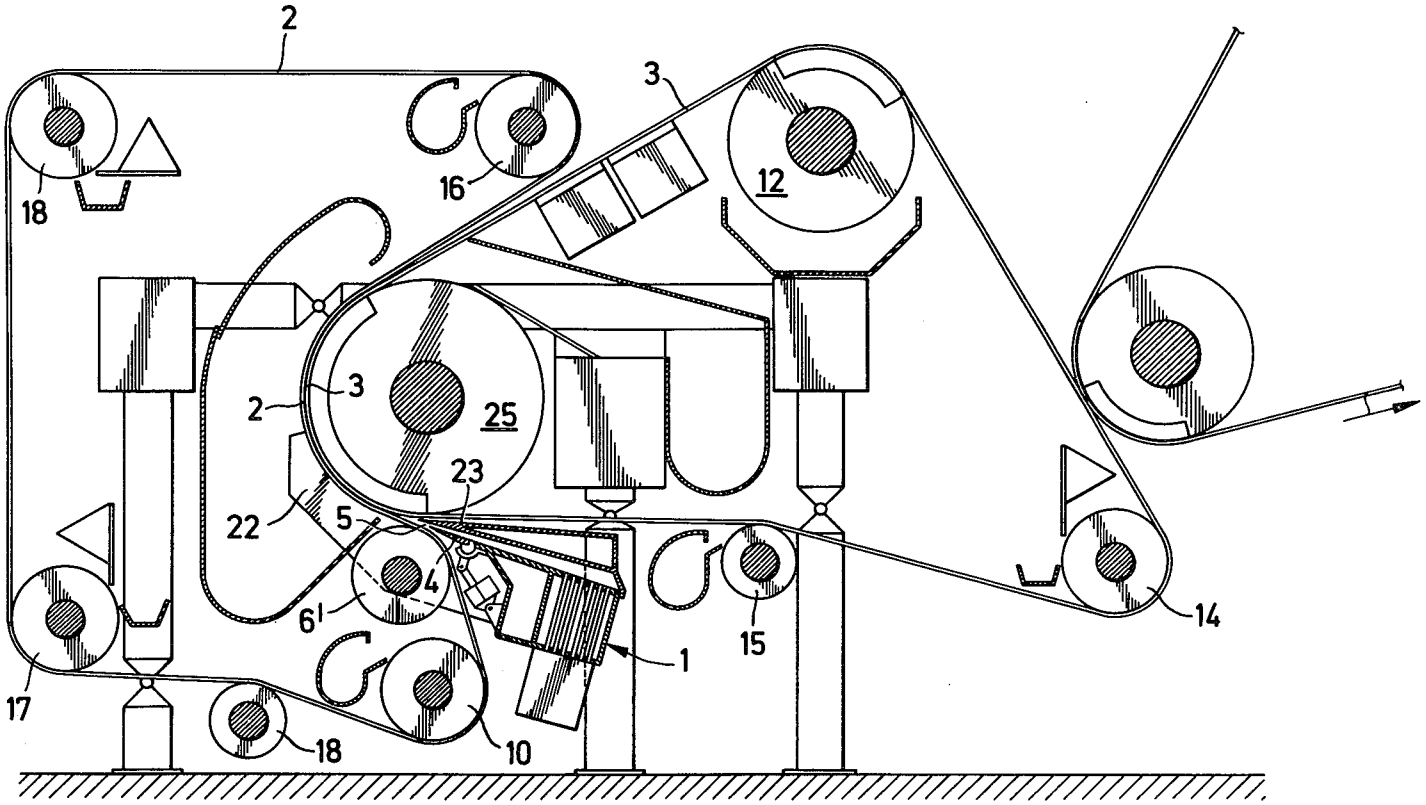
FIG. 4 shows the invention adapted to a paper machine primary unit.

In order to bring the first wire 2 into an essentially close contact with the first lip 4 of the feed box there is a forming shoe 6 or a roll 6', regulatable in the direction essentially at right angles to the wires 2, 3, on the inner side of the first wire 2, which forming shoe or roll is arranged so that it forces the first wire 2, which is guided from the breast roll 10, tightly along the regulatable first lip 4. At the same time the profile of the forming zone can be regulated in the flow direction by means of the roll 6' (FIG. 4) or the forming shoe 6. The roll 6' may also replace the breastroll 10.

Further both sides of the forming zone are tightened with vertical side walls 22, which are parallel to the wires and tightly arranged along both edges of the wires.

Figure 2:
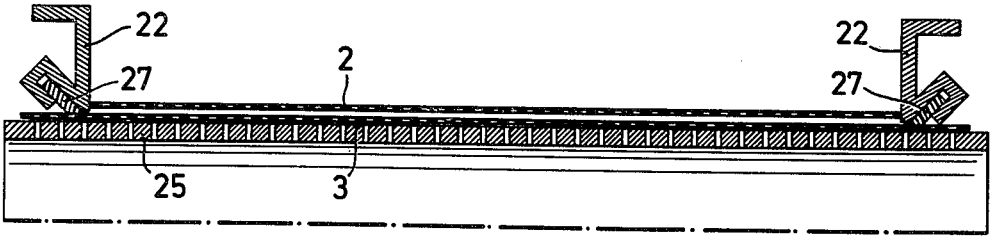
FIGS. 2 and 3 show the sections A—A and B—B in FIG. 1.
Figure 3:
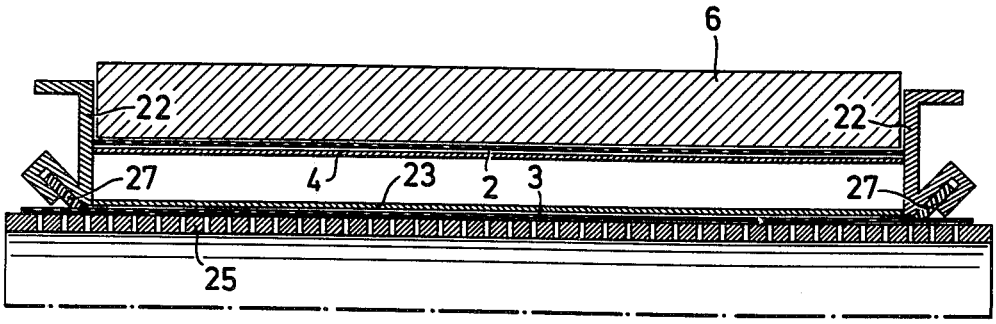

FIGS. 2 and 3 show an advantageous arrangement for accomplishing a tightening between the side walls 22 and the wires 2 and 3. In this tightening arrangement the first wire 2 is arranged between two mutually parallel side walls 22, placed at right angles to the wire 2 along both of its edges; so that the wire 2 is essentially closely connected with the side walls 22. The second wire 3 which is arranged against the cylinder, advantageously a suction cylinder 25, is on the other hand wider than the distance between the side walls 22, and reaches thus over the edges of the side walls 22, which edges comprise longitudinal seals 27 for sealing the edges of the side walls 22 closely against the second wire 3. FIG. 3 shows further, that the side walls 22 tighten against the first and second lips 4 and 23, being thus extensions of the side walls of the feed box.

What is claimed is:

1. An apparatus for forming a fibrous sheet from a fiber suspension, comprising:

first and second endless wires defining a converging forming zone therebetween;

a feed box having first and second lips defining an outlet opening for feeding the fiber suspension into an inlet end of the forming zone;

a wire cylinder equipped with suction means;

means for guiding said second wire so that it passes along the surface of said wire cylinder at least in the region of said sheet forming zone, said second wire being in sealing contact with said second lip of said feed box;

means including a breast roll for guiding said first wire into sealing contact with said first lip of said feed box, said breast roll being on the opposite side of said feed box from said wire cylinder, said first wire being arranged to be carried by the sheet being formed along said forming zone; and means defining substantially parallel side walls extending along said forming zone beyond the outlet opening of said feed box in contact with the side edges of one of said wires for defining the sides of said forming zone;

and wherein the distance between the side walls is substantially equal to the width of the first wire, but essentially smaller than the width of the second wire for sealing the edges of the first wire against the inner surface of the side walls and for sealing the edges of the side walls against the second wire.

2. The apparatus of claim 1, in which the side walls are essentially at right angles to the wires.

3. The apparatus of claim 1 wherein said side walls of the forming zone are extensions of side walls of the feed box.

* * * * *